US011141611B2

(12) United States Patent
Jones

(10) Patent No.: US 11,141,611 B2
(45) Date of Patent: Oct. 12, 2021

(54) FILTER TUBE RESPIRATOR

(71) Applicant: Faith Jones, Marina Del Rey, CA (US)

(72) Inventor: Faith Jones, Marina Del Rey, CA (US)

( * ) Notice: Subject to any disclaimer, the term of this patent is extended or adjusted under 35 U.S.C. 154(b) by 307 days.

(21) Appl. No.: 16/438,304

(22) Filed: Jun. 11, 2019

(65) Prior Publication Data

US 2019/0374797 A1 Dec. 12, 2019

Related U.S. Application Data

(60) Provisional application No. 62/683,735, filed on Jun. 12, 2018.

(51) Int. Cl.

| | |
|---|---|
| ***A62B 23/02*** | (2006.01) |
| ***A62B 23/06*** | (2006.01) |
| ***A62B 9/06*** | (2006.01) |
| ***A62B 18/08*** | (2006.01) |
| ***A62B 18/10*** | (2006.01) |
| *A62B 7/10* | (2006.01) |
| *A62B 18/02* | (2006.01) |

(52) U.S. Cl.

CPC ..... *A62B 23/02* (2013.01); *A62B 9/06* (2013.01); *A62B 18/088* (2013.01); *A62B 18/10* (2013.01); *A62B 23/06* (2013.01); *A62B 7/10* (2013.01); *A62B 18/02* (2013.01); *A62B 18/08* (2013.01)

(58) Field of Classification Search

CPC .... A62B 7/00; A62B 7/10; A62B 9/00; A62B 9/04; A62B 9/06; A62B 18/00; A62B 18/02; A62B 18/025; A62B 18/08; A62B 18/084; A62B 18/088; A62B 23/00; A62B 23/02; A62B 23/025; A62B 23/06; A41D 13/11; A41D 13/1107; A41D 13/1161

See application file for complete search history.

(56) References Cited

U.S. PATENT DOCUMENTS

| | | | | |
|---|---|---|---|---|
| 5,771,885 | A * | 6/1998 | Putrello | A62B 7/10 128/205.27 |
| 5,782,234 | A * | 7/1998 | Bates | A62B 23/06 128/204.13 |
| 6,962,156 | B2 * | 11/2005 | Michaels | A62B 23/06 128/205.27 |
| 6,971,386 | B2 * | 12/2005 | Duxbury | A62B 7/10 128/205.27 |
| 7,025,060 | B1 * | 4/2006 | Nicholson | A62B 23/06 128/206.17 |
| 7,918,225 | B2 * | 4/2011 | Dolezal | A62B 23/06 128/206.11 |
| 9,833,645 | B2 * | 12/2017 | Jones | A62B 18/10 |
| 2005/0241642 | A1 * | 11/2005 | Krzysztofik | A62B 18/08 128/206.15 |
| 2006/0085027 | A1 * | 4/2006 | Santin | A61M 29/00 606/199 |

(Continued)

*Primary Examiner* — Colin W Stuart

(57) ABSTRACT

A filter tube respirator having a filter tube and at least one breathing orifice interface. The filter tube is made of filtration material so that it is gas permeable, is substantially hollow, and has a pair of ends. The breathing orifice interface may include a nose piece, a mouth piece, and a flap piece. The filter tube has a tube breathing hole located between the ends for accepting the breathing orifice interface and has a tube valve hole opposed to the tube breathing hole for accepting a one-way valve. An attachment device selectively connects the filter tube to an individual during use.

18 Claims, 15 Drawing Sheets

(56) References Cited

U.S. PATENT DOCUMENTS

| | | | | |
|---|---|---|---|---|
| 2010/0108071 | A1* | 5/2010 | Macy, Jr. ..... | A61M 16/0666 128/206.11 |
| 2014/0261428 | A1* | 9/2014 | Chen ..... | A62B 23/02 128/205.12 |
| 2017/0050058 | A1* | 2/2017 | Konrad ..... | A62B 23/02 |
| 2017/0100612 | A1* | 4/2017 | Conge ..... | A62B 18/02 |
| 2018/0104518 | A1* | 4/2018 | Lee ..... | A62B 23/06 |

* cited by examiner

FILTER TUBE RESPIRATOR

CROSS REFERENCES AND RELATED SUBJECT MATTER

This application is a non-provisional filing of provisional patent application Ser. No. 62/683,735, filed in the United States Patent Office on Jun. 12, 2018, from which priority is claimed and which is incorporated by reference herein in its entirety.

FIELD OF INVENTION

This invention relates generally to air filtering apparatus and, more particularly to a personal air filtering apparatus.

BACKGROUND OF THE INVENTION

According to the World Health Organization (WHO), urban outdoor air pollution is estimated to cause 1.3 million deaths worldwide per year. Those living in middle-income countries disproportionately experience this burden. The American Heart Association states that air pollutants contribute measurably and significantly to both acute and chronic cardiovascular and pulmonary disease. Air pollutants are comprised of particulate matter and other gaseous chemicals that can be harmful to a person's health when inhaled. The outdoor air pollution in many cities around the world far exceeds the WHO recommended levels for health, containing an unsafe amount of particulate matter and potentially toxic gasses because of the emissions generated by the heightened industrial activity and vehicle emissions in and around those cities.

To protect themselves from breathing these harmful pollutants, some people wear respirator type masks while outdoors. These masks can either be simple cloth scarves that are wrapped around the user's nose and mouth, or more advanced masks such as an N95 disposable particulate respirator.

Respirator masks have numerous disadvantages. They cover a major portion of the user's face, usually covering the mouth and nose. Masks carry a stigma of illness. It is difficult to achieve an air tight seal around the user's face required to prevent breathing unfiltered air. It is nearly impossible to achieve a proper seal if the user has facial hair, facial deformities or sensitive skin.

Attempts have been made to address the issues of face mask respirators by creating non mask respirators. However, these non-mask respirators have their own drawbacks. For example, U.S. Pat. No. 4,915,105 shows a respiratory apparatus with a nostril intake manifold connected to two hoses that surround the user's head and join to one extension tube leading to a filter box attached to the user's waist. U.S. Pat. No. 6,971,386 shows a device with a mouthpiece and check valves leading to two tubes that encircle the user's head with the filter cartridge placed behind the user's head on the upper back or neck. The device balances on the user's shoulders and is held on by biting the mouthpiece. Each of the above devices wrap around the user's head and are difficult to manage and unwieldy to use in daily activities. They are also visually obtrusive and unattractive. Further, the distance of the filter from the breath intake orifice, particularly for U.S. Pat. No. 4,915,105 and similar devices, creates a greater drag on air flow increasing the effort necessary to inhale if the device is not powered.

U.S. Pat. Nos. 5,782,234; 5,771,885 and 7,025,060 show more compact respirators where the device is held in the user's mouth and gripped by his or her teeth. The filter is located directly in front of the user's mouth and employs air flow check valves. While these mouth-held respirators avoid the larger size and unwieldiness of the previously described respirators, these mouth-held respirators have other issues. As these respirators are held in solely by force of the teeth, the respirator will fall out if the user tries to speak without removing it entirely. If the respirator is used for extended periods, the user's jaw could tire from supporting the entire weight of the device.

Furthermore, for nostril plug type non-mask filters (see, e.g., U.S. Pat. Nos. 7,918,225 and 6,962,156), the entire filter mechanism is inserted into the user's nostrils. These are single-use devices that must be replaced after each use, and the amount of filtration material that can be used is limited to a size that fits inside a human nostril. In addition, these nostril plug type filters do not accommodate persons who prefer to breathe through their mouth, which is often necessary when engaging in strenuous exercise.

U.S. Pat. No. 20100108071 is a respirator composed of nostril inserts a filter holding device that stretches across the full face between the mouth and nose and holds the filter material and various inhalation and exhalation vents.

U.S. Pat. No. 9,833,645 is by the same inventor as the current patent. It is an unpowered personal respiratory device comprising an air filter holding member which holds the air filter media; an air tube coupled to the air filter holding member; a breathing orifice interface connected to an end of the air tube which is opposite the air filter holding member; at least one air intake check valve and air outflow check valve; and a member that is configured to attach the device to an individual. However, there still existed significant air flow and efficiency issues with all of these previous inventions, which the current invention is designed to remedy.

These are the main issues a designer must overcome to create an un-powered air filter respirator (AFR):

Filter Surface Area: A larger surface area of filtration material provides more room for air to pass through the filter thus increasing air flow. The device needs enough filtration material surface area in contact with ambient air so that sufficient air can be drawn through the material into an individual's respiratory system. In an unpowered AFR, the only force available to draw air through the AFR is the low internal pressure created by an intake of breath. The challenge non-mask AFR's face is that the filtration material surface area is relatively small thus restricting how much air can pass through the material with each intake of breath.

Filter Efficiency: The better the filtration material filters particulates, the more resistance it presents to the passage of air through it. This decreases air flow. If the user must draw hard on a breath to pull air through the filter, they will soon tire and feel out of breath.

Thus, the amount of filtered air available for breath is a continuous balancing act between these factors: the amount of low pressure within the device (the force of the user's inhalation or a powered mechanism to draw air into the device), the density (efficiency) of the filtration material and the surface area of the filtration material.

Air Tubes: In a non-mask AFR, when the filter is not directly located over the nose or mouth of the user (such as when the filter is located behind the individual's head, on a belt or strap, or in his/her pocket), the filter assembly is typically connected to the user's respiratory system (i.e. nose or mouth) by means of a tube. This allows the user to breath air filtered by the filter assembly through the connecting tube.

This tube connecting the filter to the individual's respiratory system is another source of air flow resistance—the narrower and/or longer the connecting tube, the more air flow resistance is created, and, therefore, the more force or pressure is needed to draw air into and through the AFR.

Valves: Valve are necessary in an air tight AFR to direct the air flow of oxygen depleted air (exhalation) directly out of the device to ensure that carbon dioxide rich air does not pass back into the connecting tube. When oxygen depleted air is being re-breathed, the individual soon will feel sick due to oxygen deprivation.

Some AFRs will have a one way valve to release the exhalation and a second valve that shuts to prevent exhaled air returning up the connecting tube upon exhalation. However, the mechanism that holds the valve in place narrows the connecting tube opening and the valve itself acts as an obstacle (though not a complete block as it opens) to the free flow of air from the filter media to user's lungs.

Air tightness: The next main design challenge is creating an air tight seal so that no unfiltered air passes into the individual's respiratory system. The detect of most AFR masks is that they allow a large amount of ambient (unfiltered) air into the individual's respiratory system because they do not create an air tight seal around the face.

For a non-mask AFR, one can create an air tight seal using a mouth insert—the lips close around the mouth piece creating a seal—or a nostril insert—provided the air tubes inserted into the nostrils create an air tight seal.

However, the nose and mouth are not the only passageways that must be air tight. The filtration material is normally held inside a frame or filter holding device. Thus, to be an effective filter, the entire AFR device must be air tight except for where the filtration material is in contact with ambient air. Bendable or flexible joints are very difficult to make air tight and multiple layers of material are required. This adds to the bulk and weight of the device, making it uncomfortable or cumbersome to wear.

The challenge of all of these AFR devices is how to get sufficient filtered air to the respiratory system of the individual using just the very gentle low pressure force created by a natural inhalation, while maintaining the air tightness of the system, in a device that is light and comfortable. The invention described herein satisfies each of these goals.

SUMMARY OF THE INVENTION

Embodiments of a filter tube respirator described in this application include a wearable personal respiratory device comprising a hollow tube comprised of air filter media and sealed at both ends of the tube; a breathing hole in the side of said tube for the purpose of drawing filtered air flowing through said filter tube into an individual's lungs, wherein such filtered air has passed through the filter media; a breathing orifice (mouth or nose) interface configured to create an air tight passage between the filter tube and the breathing orifice of an individual.

The device does not overly obscure the user's face. In one aspect, at least one air outflow one-way valve is configured to allow air expelled from the lungs of the individual to exit the device.

The device is light and small for easy carry and wear. In one aspect, a member is configured to connect the device to an individual's head. The device may attach to either the user's nose or mouth depending on their breathing preference and the embodiment chosen. It may be worn a number of ways—one embodiment utilizes the user's ear as a support member by having a piece that hooks over the user's ear (such as a hook or loop) to support the device. In other embodiments, the device can be attached to the user's person by means of a clip or headband.

The filtration material composing the tube may be composed of a variety of filtration materials with different filtration capabilities, including the ability to filter particulates, toxic gases and bacteria and viruses. In one aspect, the filter is disposable.

In one aspect, the device further comprises a frame forming an exo or indo skeleton for the air filter tube. In one aspect, said frame is composed of a flexible material, such as wire or plastic, such that the frame can be bent to conform to the shape of the user's face or other desired shapes.

In one aspect, the breathing orifice interface comprises a flap seal piece attached to the circumference of the tube breathing hole and such flap seal is configured to removeably adhere to the skin around an individual's breathing orifice such that it creates a direct, close communication between the tube's breathing hole and an individual's nostrils or mouth, and blocks ambient air that has not passed through the filter media from entering the breathing orifice in connection with the device. One aspect includes a small clip attached to the flap seal piece or frame and configured to removeabley attach to the nose septum of an individual.

In one aspect, the breathing orifice interface is comprised of tubular nostril inserts configured to be inserted into nostrils of an individual. In one aspect, the breathing orifice interface is comprised of a mouthpiece configured to be inserted into the mouth of an individual.

In one aspect, the device further comprises an air permeable cover configured to at least partially conceal the filter tube and the individual's breathing orifice that is in contact with the breathing orifice interface for purposes of presenting a more attractive or fashionable look.

The advantages of this design over previous designs are many. One of the best ways to increase filtered air flow is to increase the surface area of the filter. Making the entire tube out of filtration material maximizes the surface area of filtration material allowing more air to enter the device with greater ease. The larger surface area allows for greater filtration density and thus more effective pollutant filtration. The issues with air flow resistance due to a connecting tube's length and width are disposed of. The two ends of the air filtration material tube are sealed creating a tube that is fully enclosed except for the holes made for the breathing orifice interface and the exhalation valve, thus solving the issues of air tightness in the device. There is no need for additional cumbersome features to create an airtight seal around the filter and air hoses.

The whole device is incredibly light to wear as it is made mostly out of cloth. The flexibility of the frame allows it to mold comfortably to any face shape. The nosepiece embodiments leave the mouth free to talk. The nostril inserts can be one piece with different sizes for different nostrils, or the tubular nostril inserts can have nostril insert covers that attach to them. The nostril insert covers can come in different sizes, so the user can select the size that best suits the individual's nostril size to create a comfortable air tight seal.

The breathing orifice interface and one-way valve (together the "air flow holes"), while maintaining a position opposite one another, may be located at any point along the filter tube's length based on aesthetics pleasing to the designer and user. For instance, if the user wants to wear the device on one side of the face, the air flow holes are fixed at one end of the device.

In one aspect, the device has a permeable cover configured to at least partially conceal the filter tube and the individual's breathing orifice that is in contact with the breathing orifice interface. This will cover any unsightliness of the breathing orifice interface inserted into an individual's breathing orifice.

In one aspect, the filter tube can be bent into different shapes, for instance, spirals, V's, horns, curving up towards the forehead, curving back around the ears—on one or both sides of the individual's head/face (depending on placement of the air flow holes and the length of the filter tube). The filter tube may be decorated with colorful materials, patterns, crystals and images. The length of the filter tube is adaptable as the tube can be cut to any length.

The filter tube may use a headband type device to secure the respirator to the individual's head. The headband can be secured to the device at one or both ends of the filter tube. The headband can be made of a chain, ribbon, elastic or any other appropriate material. Alternatively the ends of the filter tube can be connected to the individual's person/head/hair with a clip attachment device. The device may alternatively be secured to the face solely by the breathing orifice interface.

These and other advantages of one or more aspects will become apparent from the following descriptions, taken in connection with the accompanying drawings, wherein, by way of illustration and example, embodiments of the personal air filter are disclosed.

BRIEF DESCRIPTION OF THE DRAWINGS

The drawings constitute a part of this specification and include exemplary embodiments of the filter tube respirator device, which may be embodied in various forms. It is to be understood that in some instances various aspects of the device may be shown exaggerated or enlarged to facilitate an understanding of the device.

DETAILED DESCRIPTION OF THE EMBODIMENTS

Detailed descriptions of certain embodiments are provided herein and include, but are not limited to: a nosepiece embodiment, a mouthpiece embodiment, a flap seal piece embodiment and a frame attachment embodiment. It is to be understood, however, that the present tube filter respirator may be embodied in various forms. Therefore, specific details disclosed herein are not to be interpreted as limiting, but rather as a basis for the claims and as a representative basis for teaching one skilled in the art to employ the device.

Figure 1:
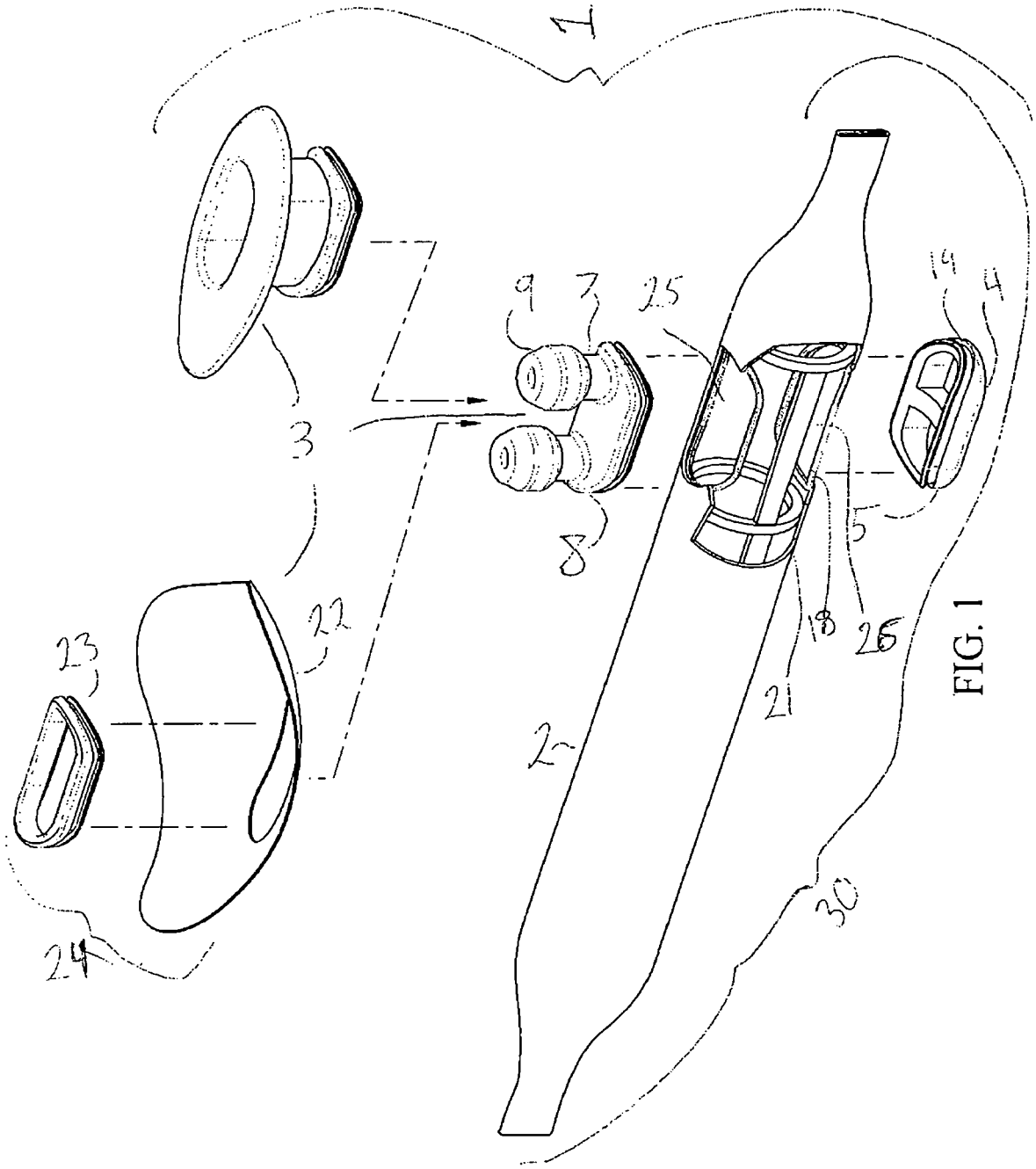
FIG. 1 is an exploded perspective view of a filter tube respirator device showing three possible breathing orifice interfaces that may be used with the air filter tube in accordance with various embodiments.

FIG. 1 shows a filter tube respirator 1, having a filter tube assembly 30. Illustrated are three embodiments of a breathing orifice interface (BOI) device 3—namely a mouthpiece 11, a nosepiece 7 and a flap seal piece 24—which may be used interchangeably with the filter tube assembly 30. The filter tube assembly 30 has a filter tube 2 that is sealed on the two ends of the tube 2 and along a horizontal seam to form a fully enclosed tube, except for at the tube breathing hole 25 and tube valve hole 26; a rib frame 21 composed of a plurality of hollow, circular ribs fitted inside filter tube 2; said frame made of a flexible, lightweight material such as, but not limited to plastic or wire. Said rib frame 21 also being disposed vertically along the longitudinal axis of a cross member connecting all ribs forming a cylindrical component therein. Filter tube 2 is semi-permeable and is composed of one or more layers of air filtration material. Said filter tube air filtration material may be comprised of particulate filtration and or chemical absorbing material, such as a high efficiency particulate air (HEPA) filter. Said filter tube 2 material comprised of a filtration material capable of withstanding direct handling abuses but also having a porosity that easily permits the passage of air. Commercially available air filtration materials including nonwoven or woven fabrics and any material meeting the National Institute for Occupational Safety and Health (NIOSH) requirements for penetration and breathing resistance, as set forth by the United States Code of Federal Regulations (CFR) 30 CFR 11(k), may be used as filter tube 2 material. The ends of said filter tube 2 and any edges thereof are sealed by any suitable means, including but not limited to thread or adhesive etc. Filter tube 2 has a pair of opposite ends and has a sidewall having two apertures near one of the ends. One of the apertures is a tube breathing hole 25 and the other aperture is a tube valve hole 26 that is at a corresponding longitudinal position as the tube breathing hole but is at an opposed position on the sidewall of the filter tube 2. The tube breathing hole 25 is configured for accepting one of the breathing orifice interface 3 devices. One way valve 4 fits into and attaches to the tube valve hole 26 by means of an O-ring 18 and O-ring groove 19 mechanism disposed on the one-way valve flange 5. Among the possible embodiments that can be created using the breathing orifice interface devices 3 shown in FIG. 1 are a nosepiece embodiment components wherein the nosepiece 7, having nostril inserts 9 and a nosepiece flange 8 is attached within the tube breathing hole 25; a mouthpiece embodiment wherein the mouthpiece 11, having a mouthpiece flange with a mouthpiece rim 13 is attached within the tube breathing hole 25; and a flap seal piece embodiment wherein a flap piece 24, having a flap seal 22, and flap seal flange 23 are attached within the tube breathing hole 25. All of said breathing orifice interface devices 3 are attached with O-rings 18. All the aforementioned embodiments will be discussed in greater detail in the following sections that describe the remaining figures herein.

Figure 2:
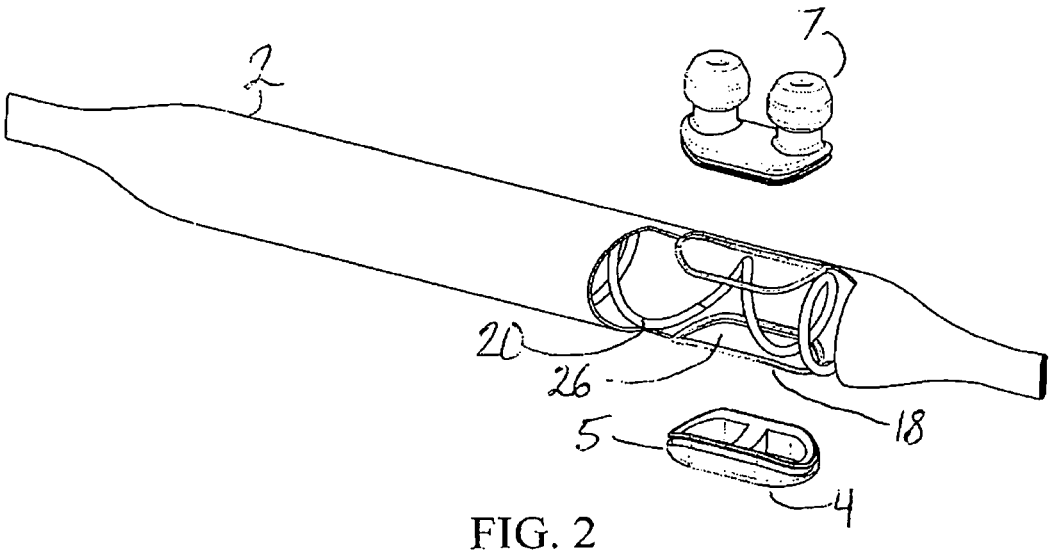
FIG. 2 is an exploded perspective view of a tubular nostril insert nosepiece embodiment of the device with a spiral frame.

FIG. 2 showing the nosepiece 7 embodiment of filter tube respirator having a spiral frame 20 extending within the filter tube 2. The spiral frame 20 may be comprised of a flexible material such as plastic or wire and the like having a coil diameter slightly less than the inner diameter of filter tube 2. Said spiral frame 20 is disposed along the longitudinal axis of said filter tube 2 and prevents said tube from collapsing during an inhale because such a collapse would inhibit an individual's breathing. This embodiment also having one-way valve 4 comprised of a planar plate made of a flexible material such as plastic and the like with a flange 5 on a side thereof allowing it to attach within the tube valve hole 26 of the filter tube 2 by means of O-ring 18, as will be discussed in greater detail herein below.

Figure 3:
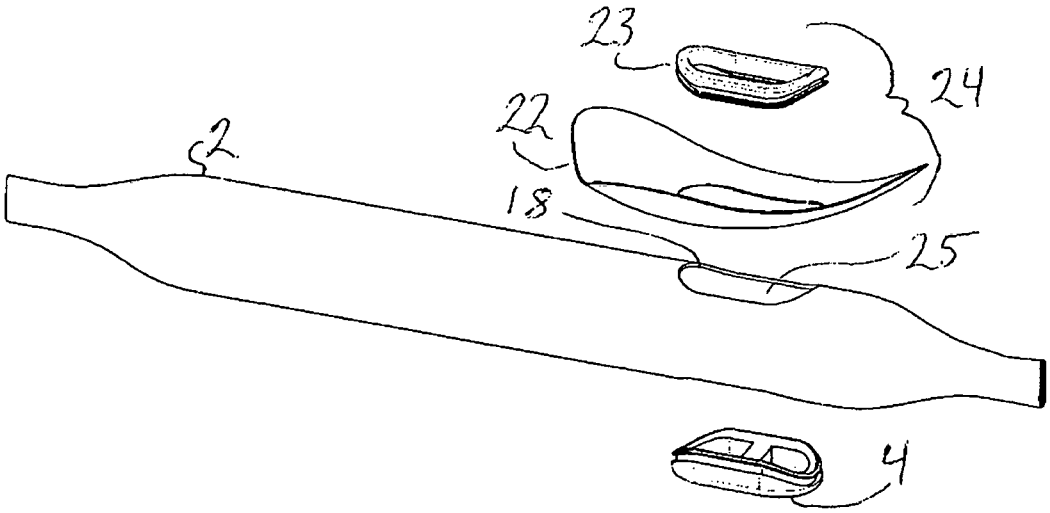
FIG. 3 is an exploded view of a flap seal piece embodiment of the device.

FIG. 3 shows the flap seal piece 24 embodiment of filter tube respirator with flap seal 22 made of a thin, flexible material such as silicone and the like and flap seal flange 23 comprised of an oval-shaped, hollow flange made of a semi-rigid material such as but not limited to plastic with a grooved edge adapted to mate with the filter tube 2 and O-ring 18 within the tube breathing hole 25.

Figure 4:
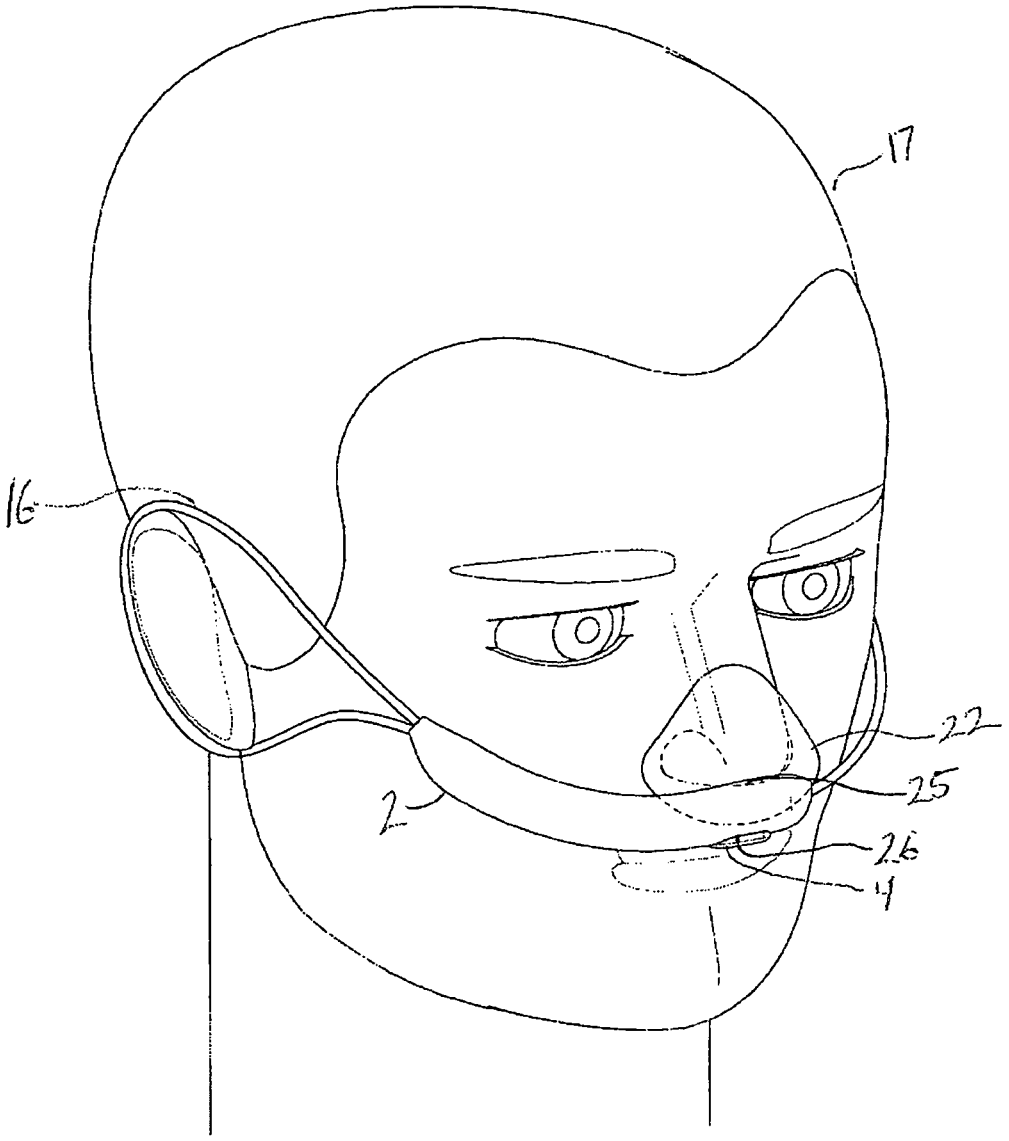
FIG. 4 is a perspective view of flap seal piece embodiment of the device as worn by an individual.

FIG. 4 depicts the flap seal piece embodiment of filter tube respirator being worn by an individual 17, having a head having ears, a longitudinal axis, and a face roughly perpendicular to the longitudinal axis of the head of the individual 17. The individual having a respiratory system. The face having at least one breathing orifice—namely a mouth and nostrils that are in gaseous communication with the respiratory system. The tube breathing hole 25 is configured to be positioned directly under one of the individual's breathing orifice to allow air from the air filter device to pass into the individual's respiratory system. This figure depicts the flap seal piece 22 covering the nose of the individual 17 creating an air tight seal except where the nostrils of individual 17 are in gaseous communication with the tube breathing hole 25. The tube valve hole 26 with one way valve 4 is positioned directly beneath the BOI on the opposite side of the tube from the tube breathing hole 25 to allow exhaled air to exit the tube filter respirator. The filter tube respirator preferably has an attachment member for connecting the filter tube 2 to the individual. As an example of the attachment member, at least one end of filter tube respirator may have one or more ear loops 16, each comprised of a line or string composed of any suitable material, including but not limited to elastic, natural or synthetic material. Said ear loop 16 has a loop-shape sized and shaped to receive a human ear. At least one ear loop is affixed to one of the ends of filter tube 2 by means of an attachment device taken from the groups of clips, knots, stitching, adhesive, etc.

Figure 5:
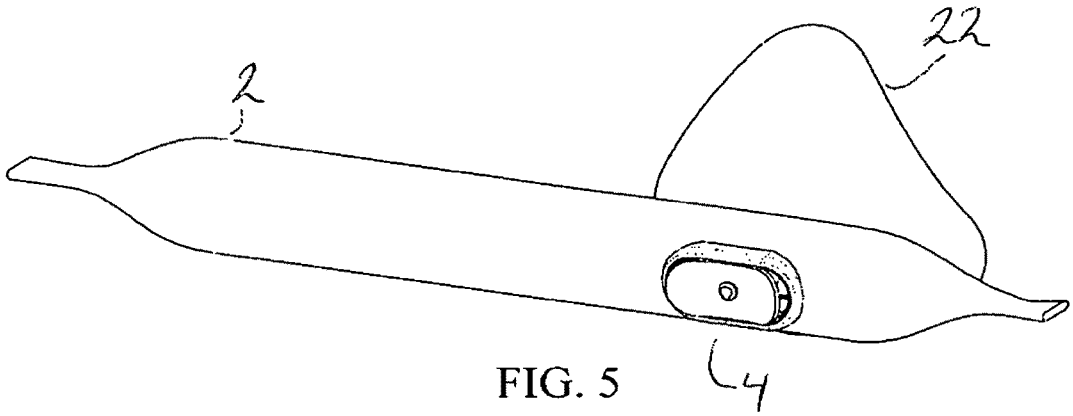
FIG. 5 is a perspective view of a flap seal piece embodiment of the device showing the exhalation one-way valve.

FIG. 5 also illustrates the flap seal piece embodiment with a bottom view showing the one-way valve 4. While a variety of one-way valve designs may be used, the image depicts the valve comprised of a planar element made of a material such as plastic and the like and having small apertures along its perimeter configured perpendicular to said planar face. A small disk made of a flexible material such as silicone and the like being affixed on a side distal to said planar face allowing exhaled air to flex said disk and exit the invention but upon an inhale seals said one-way outflow valve forcing inhaled air to enter through said filter tube 2. FIG. 5 also shows the flap seal 22.

Figure 6:
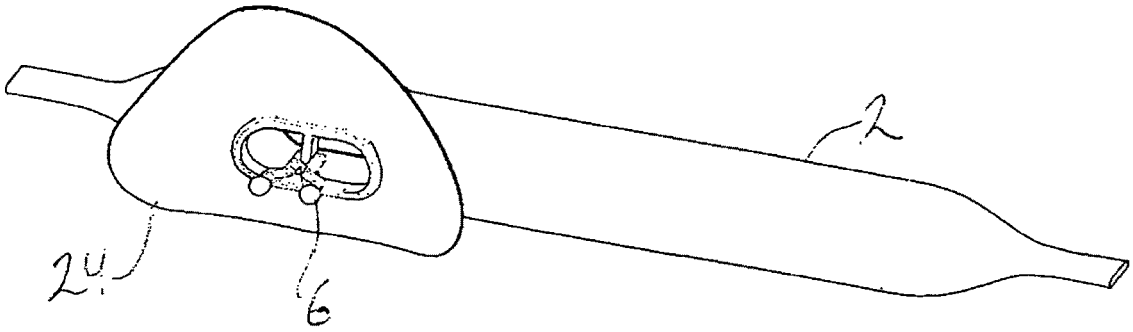
FIG. 6 is a perspective view of a flap seal piece embodiment of the device with a septum clip.

FIG. 6 shows the flap seal piece embodiment, wherein the flap seal piece 24 has a septum clip 6. While said septum clip 6 may come in a variety of shapes, the embodiment shown is comprised of a horseshoe shaped rod that has a cylindrical rod formed in a horseshoe shape protruding perpendicular to the longitudinal axis of filter tube 2. The cylindrical rod of the septum clip 6 is made of a semi-rigid material such as plastic or wire and the like and having small spherical knobs on the two ends of the horseshoe shaped rod; said clip 6 being affixed to the flap seal piece 24.

Figure 7:
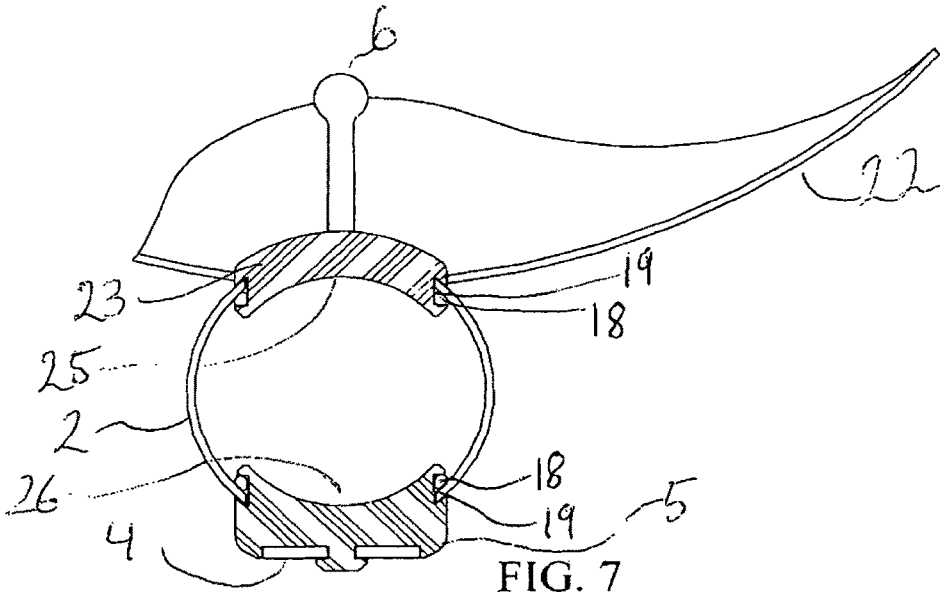
FIG. 7 is a partial section view of a flap seal piece embodiment of the device.

FIG. 7 showing a section view of filter tube 2 illustrating septum clip 6 protruding away from said filter tube 2 and connected to the flap seal piece 24. Flap seal piece 24 comprising flap seal 22 and flap seal flange 23 with a grooved edge 19 adapted to mate with the filter tube 2 and O-ring 18 within the tube breathing hole 25. This embodiment also having one-way valve 4 with a flange 5 with a grooved edge 19 allowing it to attach within the tube valve hole 26 of the filter tube 2 by means of O-ring 18

Figure 8:
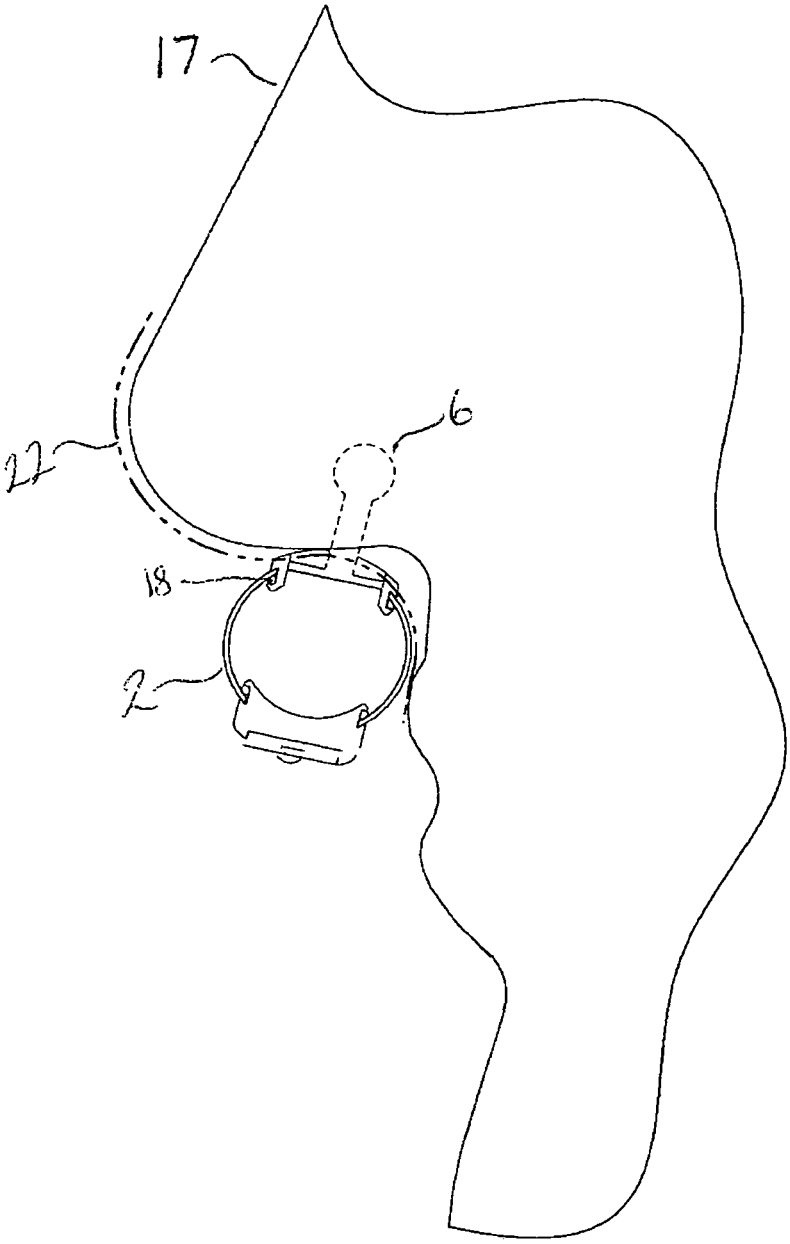
FIG. 8 is a partial section view of a person wearing a flap seal piece embodiment of the device in accordance with various embodiments.

FIG. 8 shows a section view of filter tube 2 being worn by the individual 17 with septum clip 6 being affixed to filter tube 2 by means of flap seal flange 23 and O-ring 18. FIG. 8 further shows flap seal 22.

Figure 9:
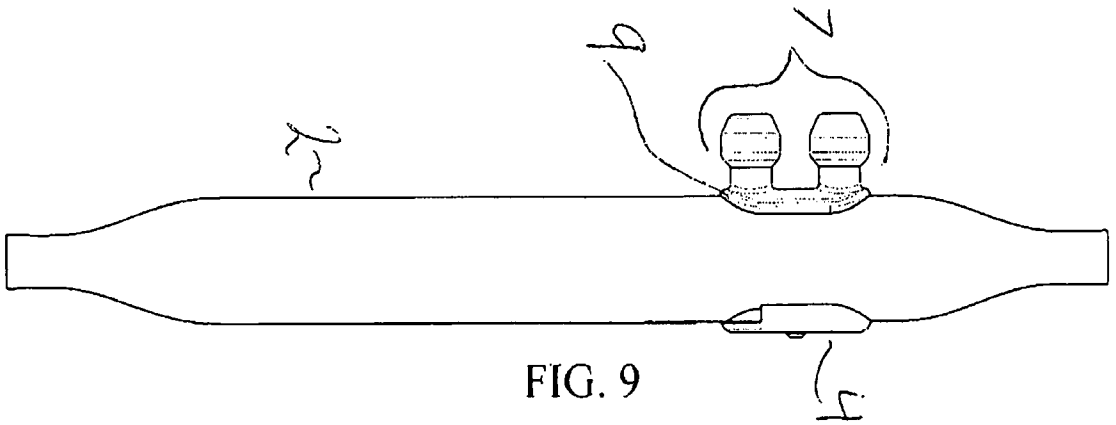
FIG. 9 is a side elevational view of a tubular nostril insert nosepiece embodiment of the device.

FIG. 9 showing an external side view of the nosepiece embodiment where the nosepiece 7 is connected to the tube 2. The nosepiece 7 has nostril inserts 9 comprised of two tubular nodes made of a flexible material such as silicone and the like that protrude perpendicular to the longitudinal axis of filter tube 2. Also shown is the one-way valve 4 attached to the filter tube.

Figure 10:
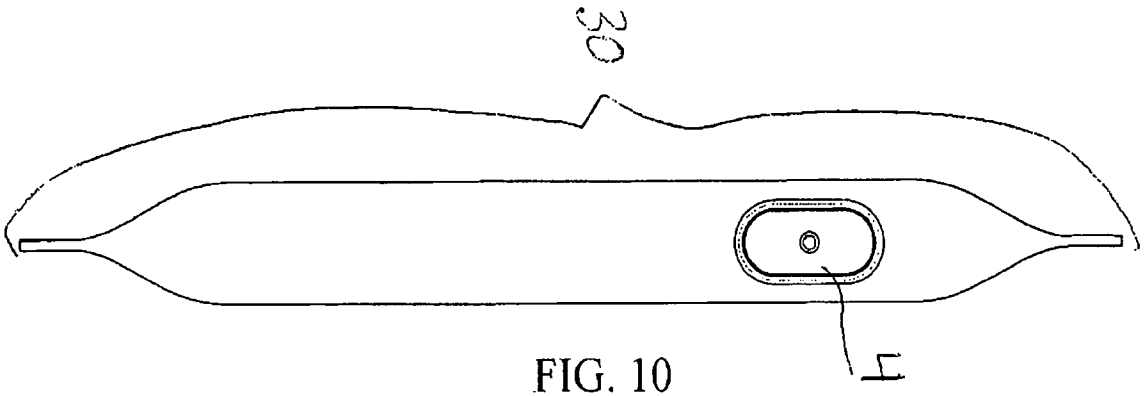
FIG. 10 is a side elevational view of the device in accordance with the various embodiments.

FIG. 10 showing a bottom view of the filter tube assembly 30 with the one-way valve 4 attached to the filter tube 2.

Figure 11:
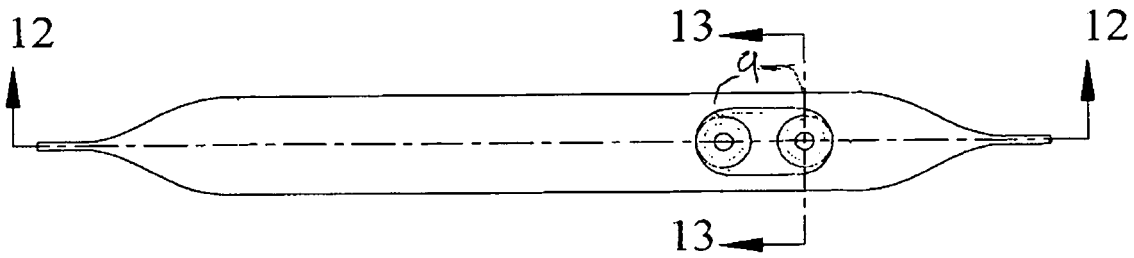
FIG. 11 is a side elevational view showing the cross section locations of FIG. 12 and FIG. 13.

FIG. 11 showing an external top view of the nosepiece embodiment with nostril inserts 9 along with filter tube 2.

Figure 12:
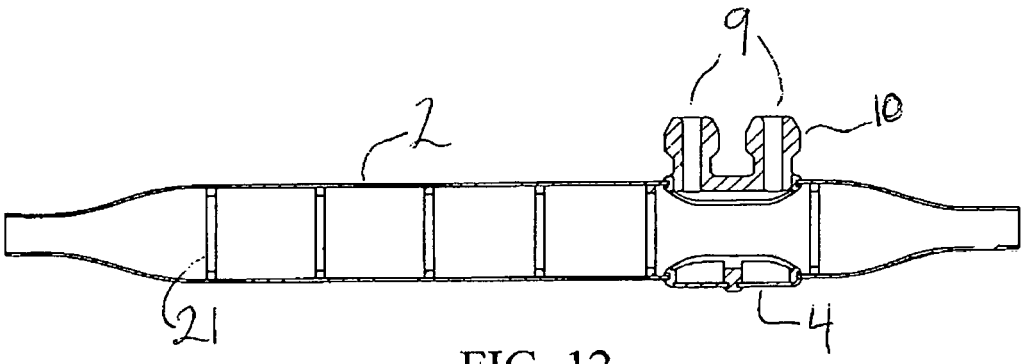
FIG. 12 is a cross section view of a tubular nostril insert nosepiece embodiment of the device, taken generally in the direction of line 12-12 in FIG. 11.

FIG. 12 showing a section view of the nosepiece embodiment with nostril inserts 9 allowing a user to inhale through their nostrils while wearing the invention. The aforementioned nostril inserts 9 can be provided in a plurality of diameters to allow them to fit into a variety of nostril orifices. The tubular nostril insert can have a nostril insert flexible cover 10 that come in a plurality of diameters. FIG. 12 also illustrates the rib frame 21.

Figure 13:
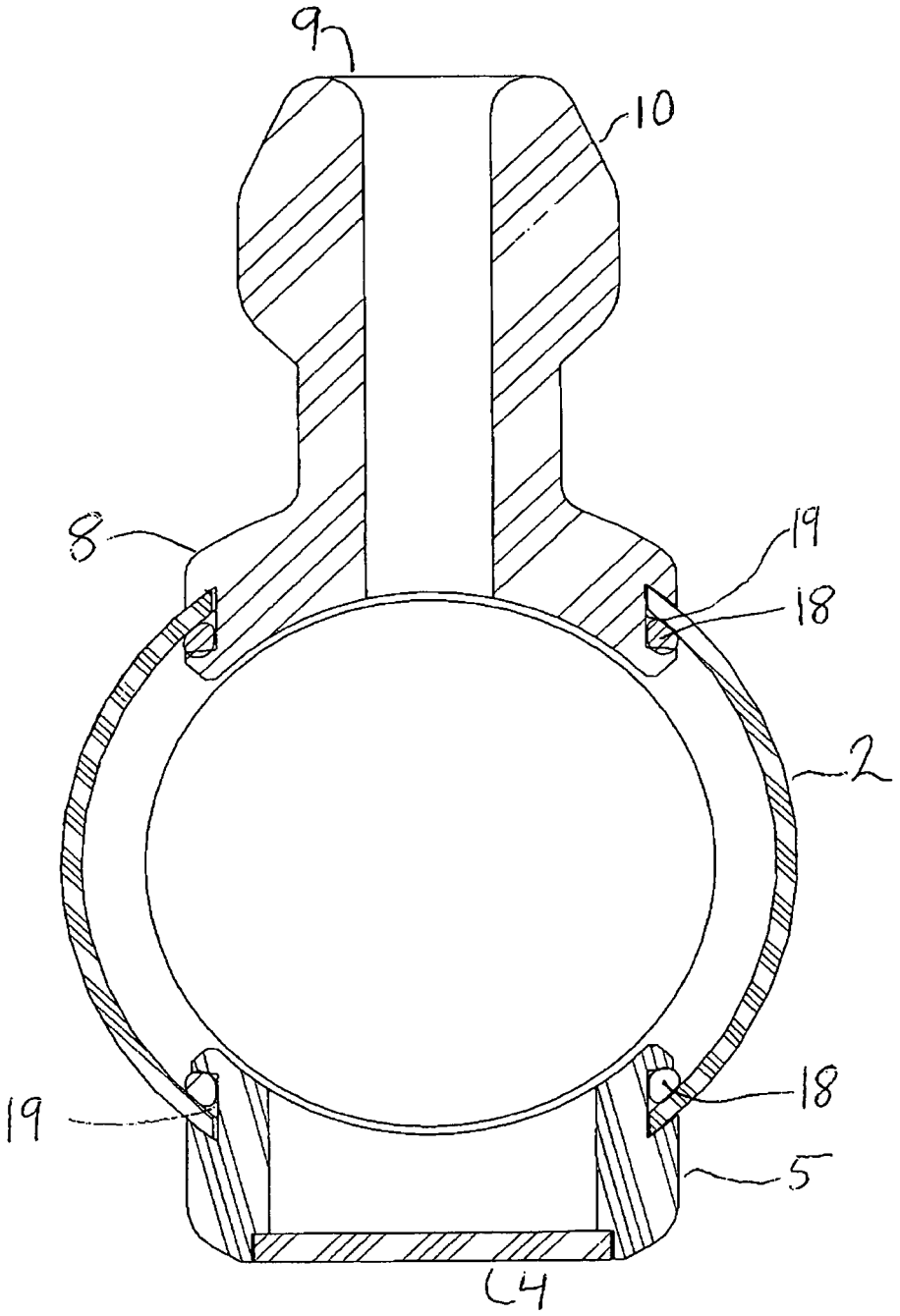
FIG. 13 is a partial section view of the tubular nostril insert nosepiece embodiment, taken generally in the direction of line 13-13 in FIG. 11, showing the O-ring and groove mechanism as a possible option for attaching a breathing orifice interface and one-way valve to the filter tube.

FIG. 13 showing a close-up section view of nosepiece embodiment with nostril inserts 9, nostril insert flexible cover 10, and one-way valve 4. This view details the O-rings 18 disposed in O-ring grooves 19 of nosepiece flange 8 and one-way valve flange 5 trapping the filter tube 2 between the O-ring and O-ring grooves allowing for an air tight seal. Said seal may also be formed by an adhesive attachment such as, but not limited to, epoxy and the like, rather than the O-ring and O-ring groove attachment. Said O-rings 18 are roughly circular in shape and made of a flexible material rubber such as VITON and the like and enhance an air tight seal.

Figure 14:
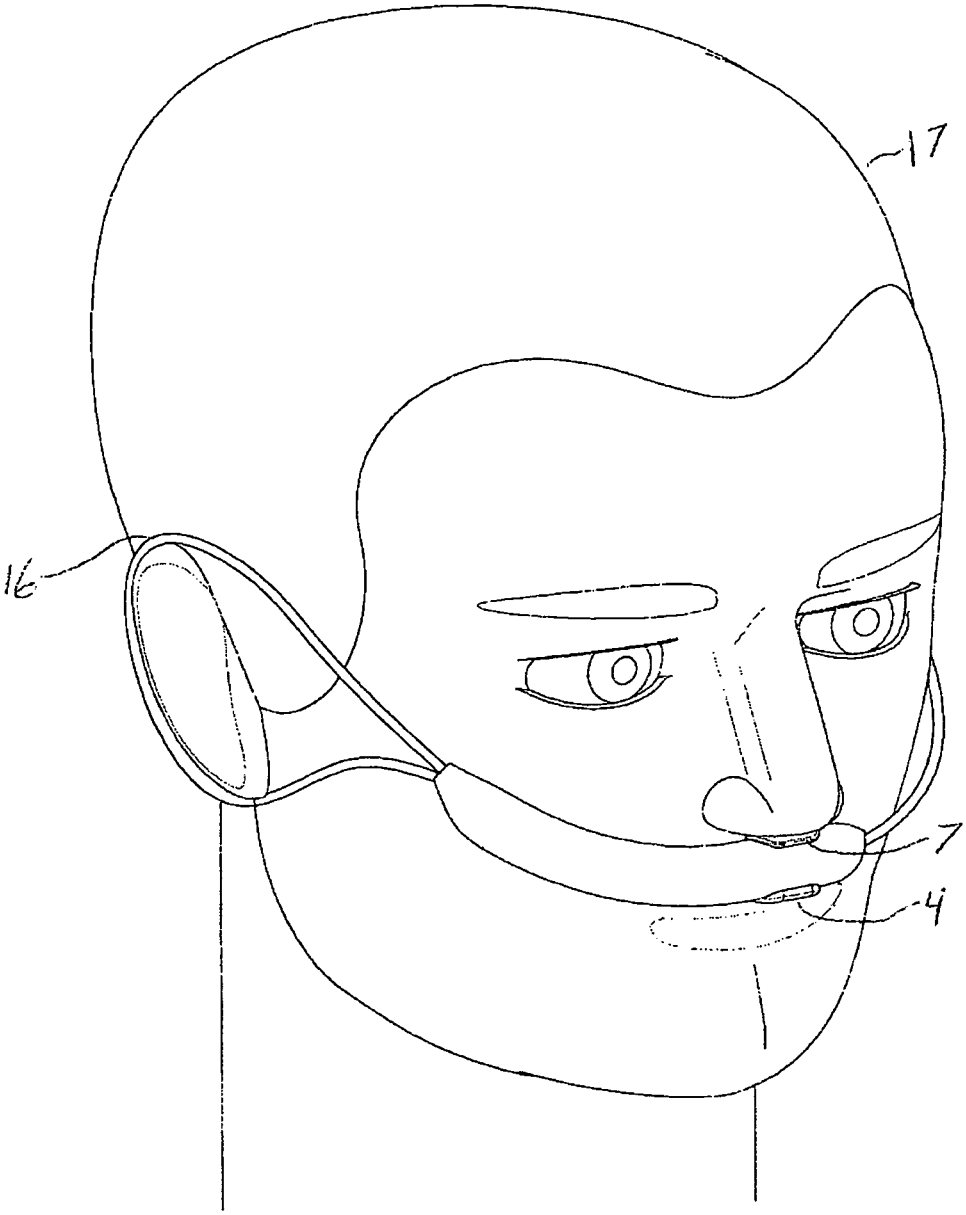
FIG. 14 is a perspective view of a tubular nostril insert nosepiece embodiment with ear loop version of the device as worn by an individual in accordance with various embodiments.

FIG. 14 shows another external left side perspective view of the nosepiece 7 embodiment of the invention also being worn across one side of the face of the individual 17 and perpendicular to the longitudinal axis of the head of the individual 17. The figure also showing the invention being selectively affixed to the ears of the individual 17 by means of ear loop 16 made of a flexible string-like material such as nylon and rubber and the like. Also shown is the one-way valve 4.

Figure 15:
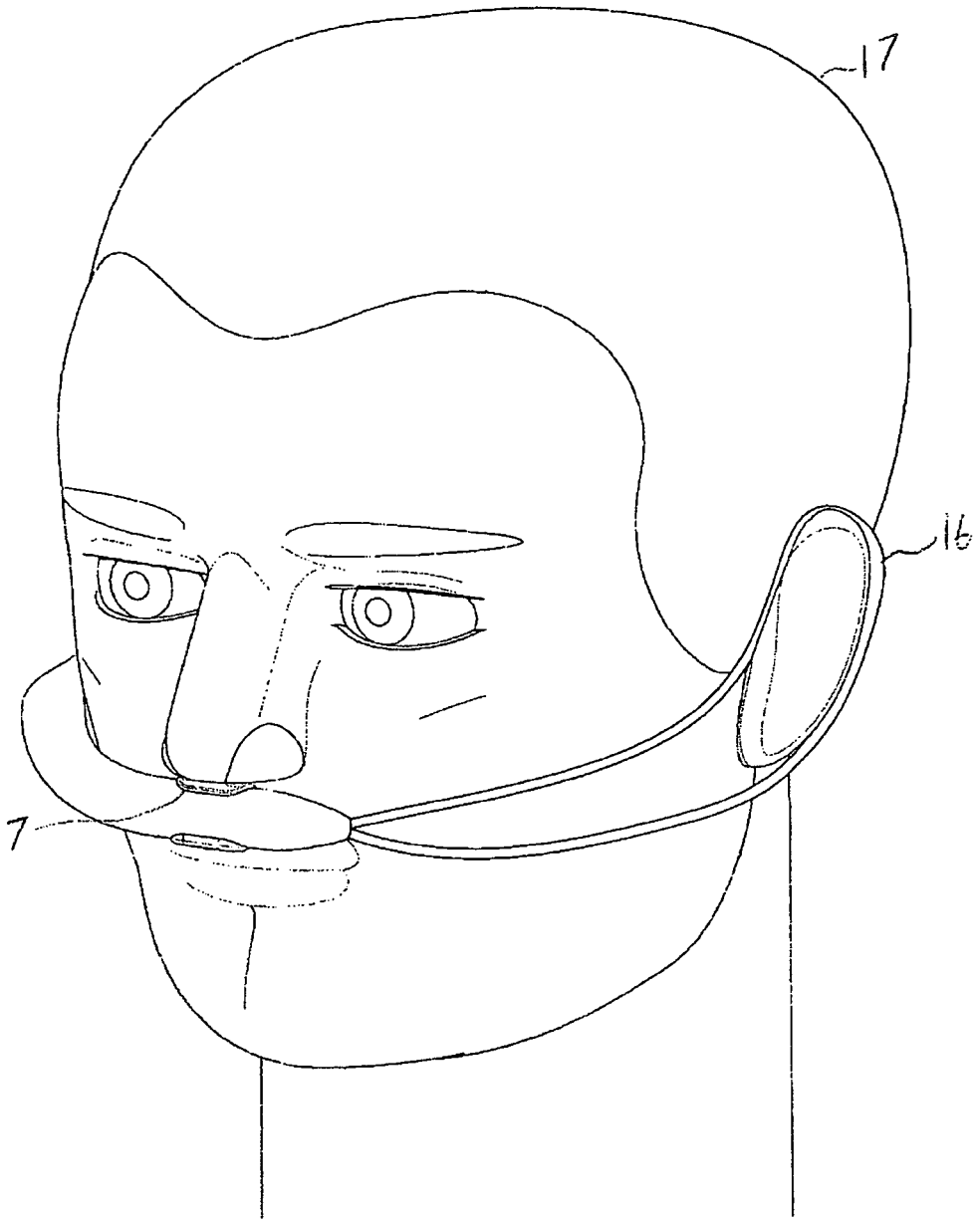
FIG. 15 is a perspective view of tubular nostril insert nosepiece embodiment with ear loop version of the device as worn by an individual in accordance with various embodiments.

FIG. 15 showing an external right side perspective view of the nosepiece 7 embodiment of the invention also being worn across one side of the face of the individual 17 and perpendicular to the head of the individual 17. The figure also showing the invention being selectively affixed to the ears of the individual 17 by one of the ear loops 16.

Figure 16:
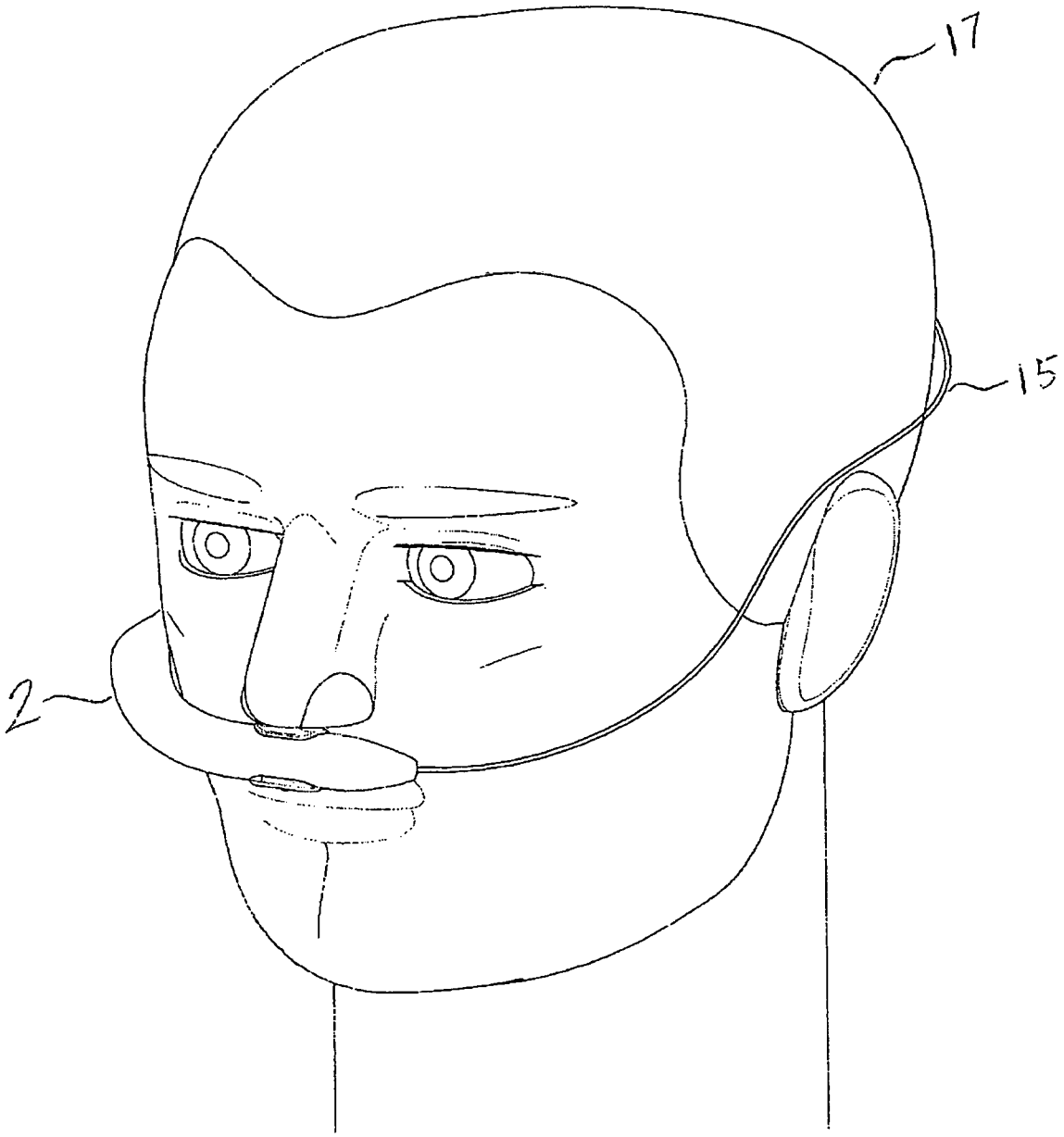
FIG. 16 is a perspective view of a headband version of the device as worn by an individual in accordance with various embodiments.

FIG. 16 shows another external left side perspective view of the nosepiece embodiment of the invention also being worn across one side of the face of the individual 17 and perpendicular to the longitudinal axis of the head of the individual 17. Also shown is a headband that is secured to the ends of the filter tube 2, and the invention being selectively affixed to the head of the individual 17 by means of the headband 15. The headband 15 is made of a flexible string-like material such as nylon and rubber and the like.

Figure 17:
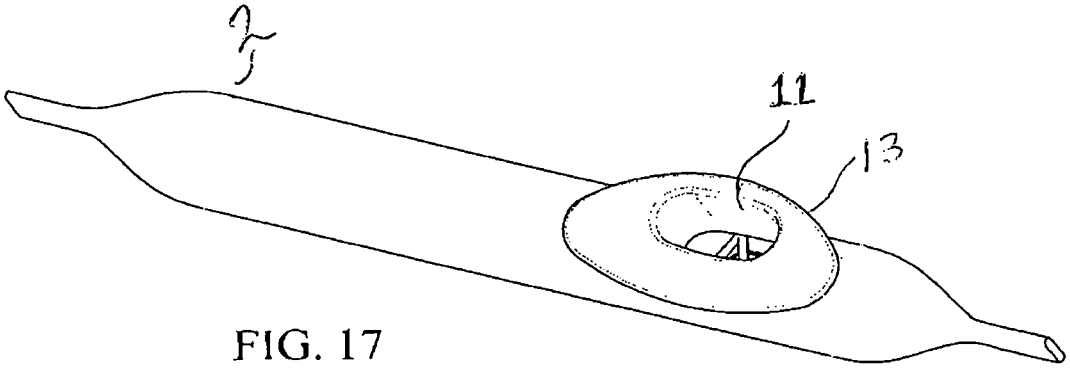
FIG. 17 is a perspective view of an inserted mouthpiece embodiment of the device.

FIG. 17 depicts the mouthpiece embodiment of the invention with the mouthpiece rim 13 made of a flexible material such as silicone and the like: said mouthpiece 11 being affixed to filter tube 2.

Figure 18:
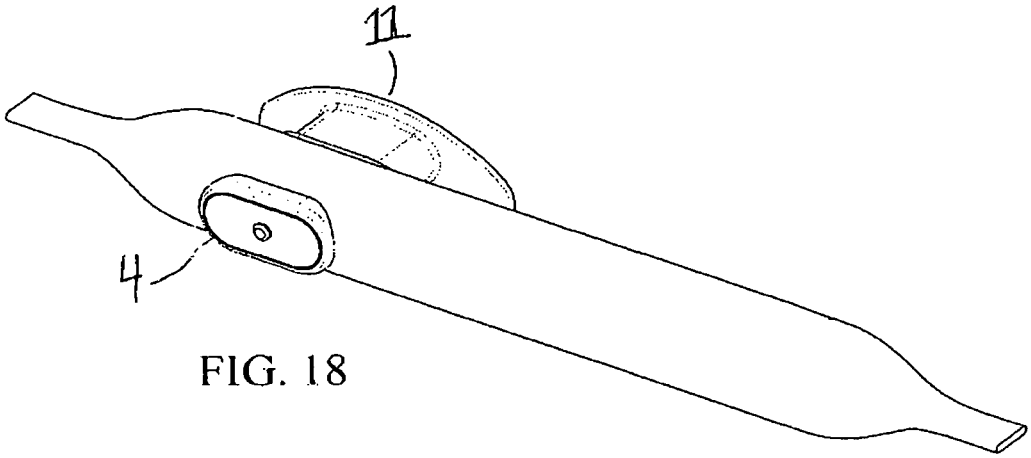
FIG. 18 is a perspective view of an inserted mouthpiece embodiment of the device.

FIG. 18 depicts the bottom side of mouthpiece embodiment of the invention showing the one-way valve 4.

Figure 19:
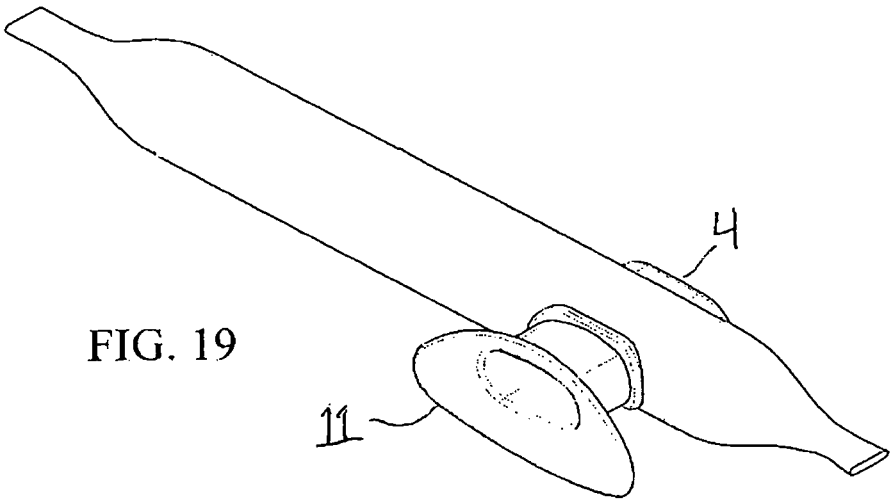
FIG. 19 is a perspective view of an inserted mouthpiece embodiment of the device.

FIG. 19 depicting an alternate view of the mouthpiece embodiment of the invention with mouthpiece 11 and one way valve 4.

Figure 20:
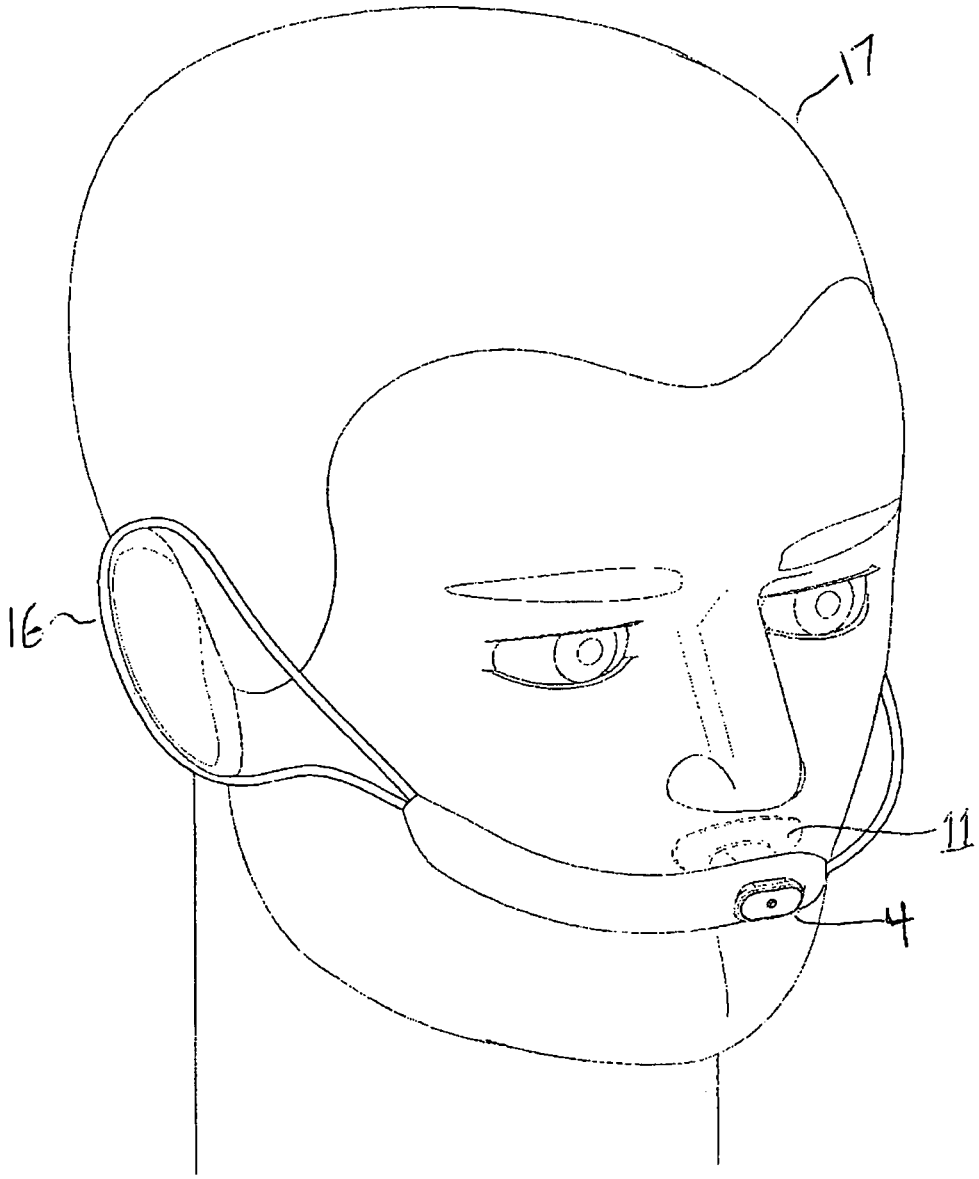
FIG. 20 is a perspective view of an inserted mouthpiece version of the device as worn by an individual in accordance with various embodiments.

FIG. 20 showing another external side perspective view of the mouthpiece embodiment of the invention also being worn across one side of the face of the individual 17 and perpendicular to the longitudinal axis of the head of the individual 17. The figure also showing the invention being selectively affixed to the ears of the individual 17 by means of the ear loops 16. Also shown is the one-way valve 4 and mouthpiece 11.

Figure 21:
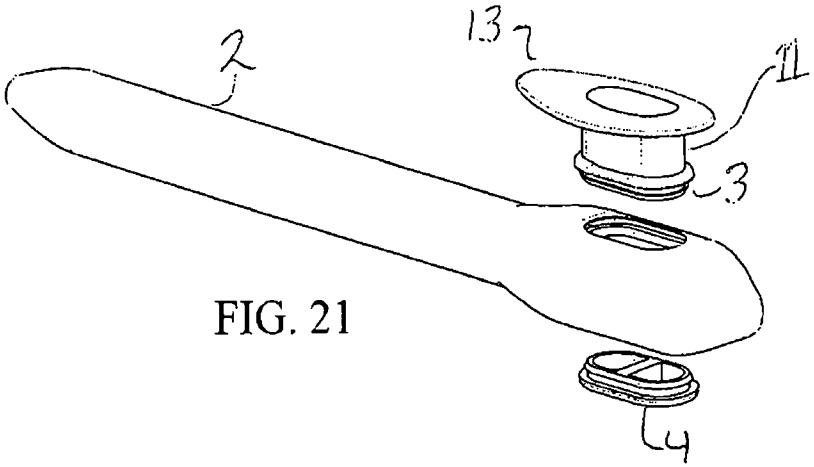
FIG. 21 is an exploded view of an inserted mouthpiece embodiment of the device showing an alternate tube frame structure with an alternate breathing orifice interface and one-way valve attachment mechanism.

FIG. 21 shows an exploded view of an alternate frame attachment embodiment of the invention wherein the breathing orifice interface 3 and one-way valve 4 affix/snap into grooved apertures built into in the frame, rather than using an O-ring 18 attachment mechanism. While FIG. 21 shows the mouthpiece embodiment of the invention, any of the BOI embodiments may be used with this alternate frame attachment embodiment. FIG. 21 further shows the filter tube 2, one-way valve 4, mouthpiece 11 and mouthpiece rim 13.

Figure 22:
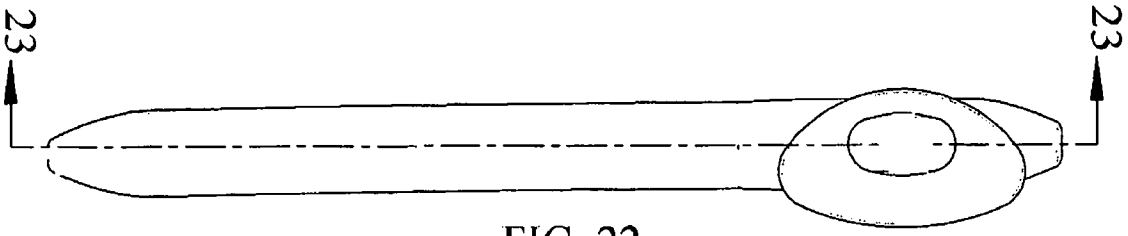
FIG. 22 is a side elevational view of the device in FIG. 21 showing the location of the cross section view of FIG. 23.
Figure 23:
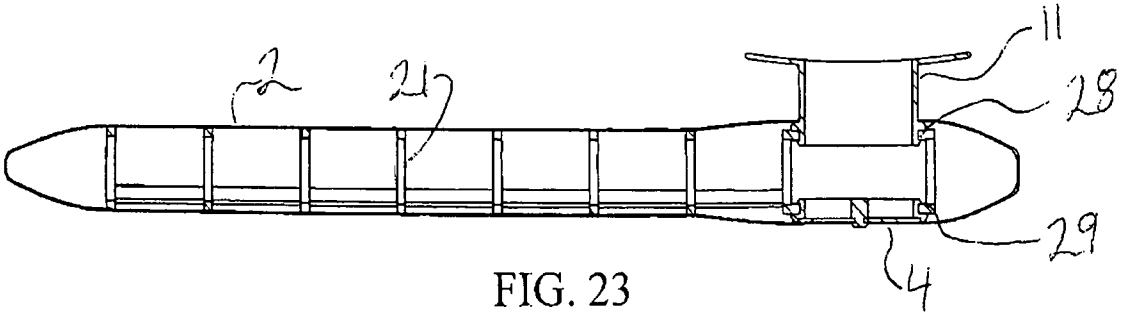
FIG. 23 is a cross section view of an alternate embodiment of the device.

FIG. 22 depicts a top view of the mouthpiece embodiment of the invention showing the location of the cross section depicted in FIG. 23.

FIG. 23 depicts a section view of the alternate frame embodiment of the invention showing the mouthpiece 11 and one-way valve 4 fitted into the frame attachment grooves 28 and 29, respectively, of the rib frame 21 inside of filter tube 2.

Figure 24:
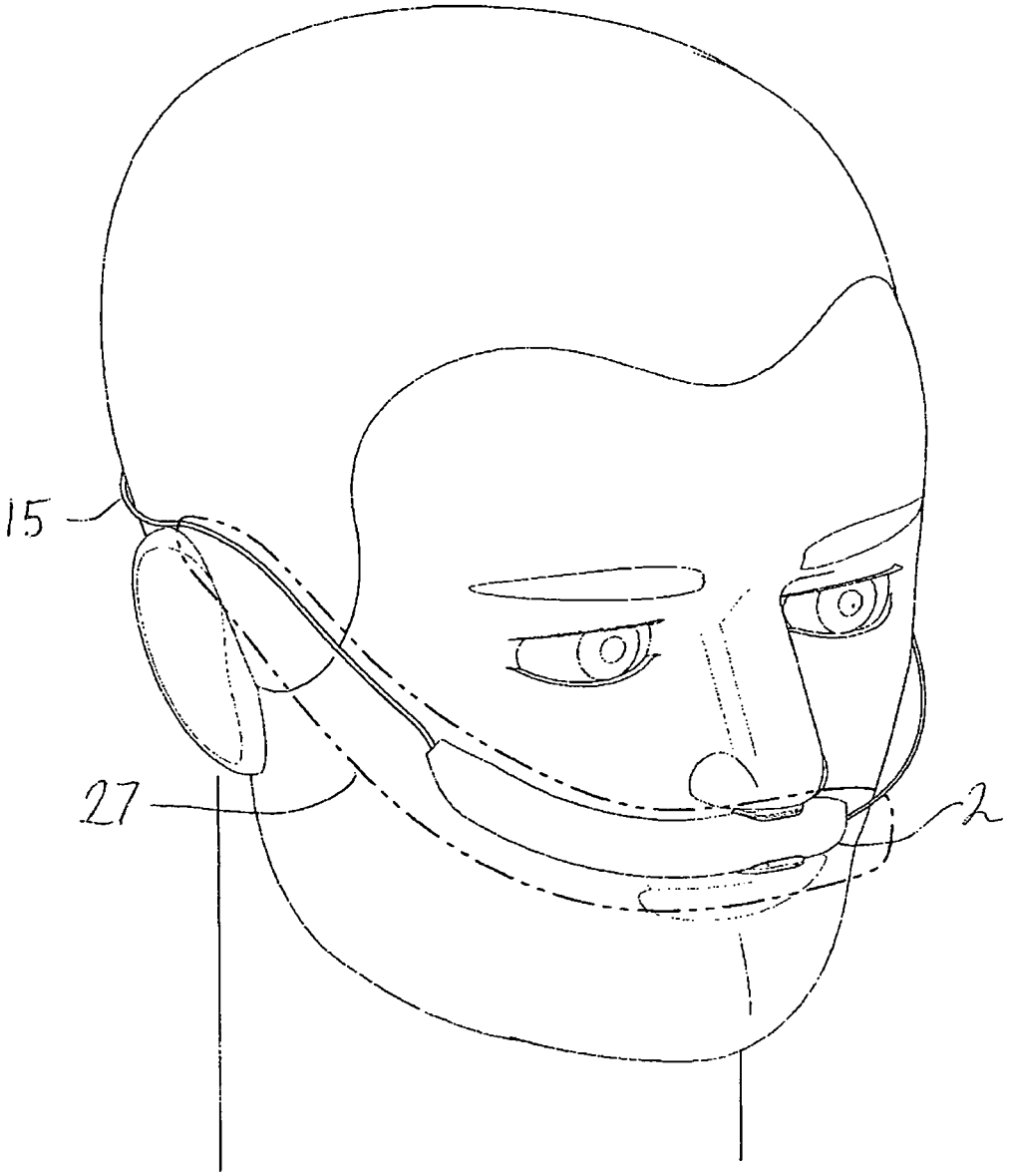
FIG. 24 is a perspective view of an alternate embodiment of the device with a cover as worn by an individual in accordance with various embodiments.

FIG. 24 shows another external side perspective view of the nosepiece embodiment of the invention being worn across one side of the face of the individual 17. The air tube 2 is affixed to the head of the individual 17 by the headband 15. Also shown is a tube cover 27 affixed to the outside of the device configured to obscure the sight of the air tube from view. The tube cover 27 may be made in any variety of materials, metal, plastic, cloth so long as it is light and air permeable.

Furthermore, the tube breathing hole 25 and one-way valve hole 26 may be placed opposite each other at any point along the length of the tube, depending on the style desired by an individual (center or to one side).

In addition, in order to more securely and comfortably affix the filter tube to an individual's head, on the side of the filter tube in contact with an individual's face, can be affixed a thin strip of soft plastic material, such as silicone, that will gently cling when in contact with an individual's skin. This can help support the device.

The above description and drawings show a novel device for a personal air filtration system that can be worn in an unassuming way, without covering major portions of the user's face and yet provide effective filtration of common outdoor air pollutants.

While the personal air filter device has been described in connection with a number of embodiments, it is not intended to limit the scope of the device to the particular form set forth, but on the contrary, it is intended to cover such alternatives, modifications, and equivalents as may be included within the spirit and scope of the device as defined by the appended claims. For example, although the frame and various attachment pieces are preferably made out of plastic, other materials may similarly be used, such as metal and bio-plastic.

The tube cover is intended to create a more fashionable appearance to the filter tube respirator. It is contemplated that the tube cover will be produced in many colors, shapes and patterns, again allowing users to personalize the device.

Additionally, the filter tube material can be scented or flavored. In addition, the device may contain a pollutant sensor to indicate when the filter should be replaced. The device may further contain a mechanism to alert the user to the levels of pollution in the area the user is using the device, and a mechanism to notify the user when the filter should be replaced.

What is claimed here is:

1. A personal respiratory device, for use by an individual having a breathing orifice, comprising:

a filter tube that is hollow, has a pair of ends, and is made of air filter media and sealed at both ends of the tube; a breathing hole in a side of said tube for the purpose of drawing filtered air flowing through said filter tube into an individual's lungs, wherein the filtered air passes through the filter media; and a breathing orifice interface attached within the breathing hole and configured to create an air tight passage between the filter tube and the breathing orifice of an individual.

2. The device as recited in claim 1, further comprising a one-way valve configured to allow air expelled from the lungs of the individual to exit the device.

3. The device as recited in claim 1, further comprising a frame connected to the filter tube wherein said frame forms an exo or endo skeleton for the filter tube.

4. The device as recited in claim 3, wherein said flame is composed of flexible material such that the frame can be bent into a variety of shapes.

5. The device as recited in claim 1, wherein said breathing orifice interface comprises a flap attached to the circumference of said breathing hole in the filter tube and said flap is configured to removeably adhere to the skin around an individual's breathing orifice such that it creates a direct, close communication between the tube's breathing hole and an individual's nostrils or mouth and blocks ambient air that has not passed through the filter media from entering the breathing orifice in connection with the device.

6. The device as recited in claim 5, wherein the individual has a nose septum and further comprising a small clip attached to the breathing orifice interface configured to removeably attach to the nose septum of the individual.

7. The device as recited in claim 1, further comprising an attachment member configured to connect the device to the head of an individual.

8. The device as recited in claim 7, wherein the attachment member that is configured to connect the personal respiratory device to an individual further comprises an interchangeable attachment allowing a user to removeably or fixedly attach a member selected from the following group of attachment devices comprising clips, headbands and hooks.

9. The device as recited in claim 7, wherein said attachment member further comprises a headband; said headband attached to said air filter tube and is configured to allow said air filter tube to be removably attached to the head of the individual.

10. The device as recited in claim 1, wherein the individual has nostrils and wherein the breathing orifice interface further comprises a nose piece having tubular inserts that are configured to be inserted into the nostrils of the individual.

11. The device as recited in claim 10, wherein said tubular inserts have flexible covers removeabley or fixedly attached.

12. The device as claimed in claim 1, wherein the individual has a mouth, and wherein the breathing orifice interface further comprises a mouthpiece, said mouthpiece configured to be inserted into the mouth of the individual.

13. The device as recited in claim 1, wherein said breathing hole further comprises an attachment mechanism that allows a user to connect to the filter tube a breathing orifice interface selected from the group consisting of a nose piece, a mouthpiece, and a flap seal.

14. The device as recited in claim 1, further comprising an air permeable cover configured to at least partially conceal the filter tube and the individual that is in contact with the breathing orifice interface.

15. The device as recited in claim 1, further comprising a fragrance or flavor element.

16. The device as claimed in claim 1 further comprising a pollution sensor device to notify the user when the filter should be replaced.

17. The device as claimed in claim 1 further comprising a pollution sensor mechanism that informs the individual of pollution levels.

18. The device as recited in claim 1, further comprising an ear hook that is attached to one of the ends of the tube, is configured to loop around at least one ear of the individual.

* * * * *